US006453869B1

(12) United States Patent
Moore

(10) Patent No.: US 6,453,869 B1
(45) Date of Patent: Sep. 24, 2002

(54) INTERNAL COMBUSTION ENGINE WITH VARIABLE RATIO CRANKSHAFT ASSEMBLY

(75) Inventor: Ralph Moore, Anchorage, AK (US)

(73) Assignee: Mooremac, LLC, Anchorage, AK (US)

( * ) Notice: Subject to any disclaimer, the term of this patent is extended or adjusted under 35 U.S.C. 154(b) by 0 days.

(21) Appl. No.: 09/755,306

(22) Filed: Jan. 4, 2001

(51) Int. Cl.[7] ..... F02B 75/32
(52) U.S. Cl. ..... 123/197.4
(58) Field of Search ..... 123/48 R, 48 B, 123/78 F, 197.1, 197.4

(56) References Cited

U.S. PATENT DOCUMENTS

| | | | |
|---|---|---|---|
| 460,642 | A | 10/1891 | Kitson |
| 1,177,913 | A | 4/1916 | Zeitlin |
| 1,207,429 | A | 12/1916 | Morison |
| 1,964,096 | A | 6/1934 | Tucker |
| 3,686,972 | A | 8/1972 | McWhorter |
| 3,861,239 | A | 1/1975 | McWhorter |
| 4,152,955 | A | 5/1979 | McWhorter |
| 4,887,560 | A | 12/1989 | Heniges |
| 5,158,047 | A | 10/1992 | Schaal et al. |
| 5,178,038 | A | 1/1993 | Heniges |
| 5,927,236 | A | 7/1999 | Gonzalez |

FOREIGN PATENT DOCUMENTS

| | | | |
|---|---|---|---|
| JP | 3-31535 | * | 2/1991 |

* cited by examiner

*Primary Examiner*—Noah P. Kamen
(74) *Attorney, Agent, or Firm*—Liniak, Berenato, Longacre & White

(57) ABSTRACT

An internal combustion engine including at least one cylinder having a central axis and a variable ration crankshaft assembly employed to extend a dwell point of a piston and improve connecting rod leverage. The crankshaft assembly comprises a gear set having a gear ratio 1:1 and including a first gear member non-rotatably mounted to an engine block and meshing a second gear member drivingly coupled to an eccentric member rotatably mounted between to a crankpin of the crankshaft assembly and a connecting rod, defining an offset lever extended between axes of rotation of the eccentric member and a lower end of the connecting rod connected to the crankshaft assembly. The eccentric member is positioned on the crankpin so that the offset lever is perpendicular to the central axis when the piston reaches TDC. Such an arrangement allows extending a dwell point of a piston and improving connecting rod leverage, thus increasing efficiency of the mechanical conversion process. The invention is applicable to both two- and four-stroke cycle engines.

17 Claims, 7 Drawing Sheets

INTERNAL COMBUSTION ENGINE WITH VARIABLE RATIO CRANKSHAFT ASSEMBLY

BACKGROUND OF THE INVENTION

1. Field of the Invention

The present invention relates broadly to internal combustion engines and, more particularly, to an internal combustion engine having a variable ratio crankshaft assembly for varying a stroke of the internal combustion engine over all strokes of engine operation. The present invention is applicable to both two- and four-cycle engines.

2. Description of the Prior Art

Conventional fixed stroke internal combustion engines operate according to a predetermined cycle characterized by four consecutive phases: intake, compression, expansion, and exhaust. In such engines, pistons reciprocate between a top dead center (TDC) and a bottom dead center (BDC). A distance the piston travels during an excursion through the cylinder between TDC and BDC is called a stroke. A four-stroke cycle engine requires four piston strokes (or two full revolutions of a crankshaft) to complete one cycle. In contrast, a two-stroke cycle engine requires two piston strokes (or one full revolution of the crankshaft) to complete one cycle. "Cycle" is used to describe the complete power cycle, such as Otto cycle. This usage is consistent within this art and, in context, should not confuse those skilled in the art.

The internal combustion engines having a variable ratio crankshaft assemblies (or variable stroke crankshaft assemblies) are well known in the prior art. This is achieved by means of an arrangement that varies the position of the piston relative to a head of the cylinder. Such an arrangement is used to modify the effective piston strokes, such as to increase the stroke during the expansion event to increase the torque output, and/or to reduce the piston stroke during the intake and exhaust portions of the cycle, in order to increase the efficiency of the internal combustion engine.

SUMMARY OF THE INVENTION

The present invention provides an improved internal combustion engine including at least one cylinder having a central axis and a variable ration crankshaft assembly employed to extend a dwell point of a piston and improve connecting rod leverage. The crankshaft assembly comprises a gear set having a gear ratio 1:1 and including a first gear member non-rotatably mounted to an engine block and meshing a second gear member drivingly coupled to an eccentric member rotatably mounted between to a crankpin of the crankshaft assembly and a connecting rod, defining an offset lever extended between axes of rotation of the eccentric member and a lower end of the connecting rod connected to the crankshaft assembly. The eccentric member is positioned on the crankpin so that the offset lever is perpendicular to the central axis when the piston is in its TDC position. Such an arrangement allows extending a dwell point of a piston and improving connecting rod leverage, thus increasing efficiency of the mechanical conversion process.

The invention is applicable to both two- and four-stroke cycle engines. The invention is also applicable to multi-cylinder engines of various configurations, such as in-line engines, "V" engines, and opposed-cylinder engines.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENTS

The preferred embodiments of the present invention will now be described with the reference to accompanying drawings.

Figure 1:
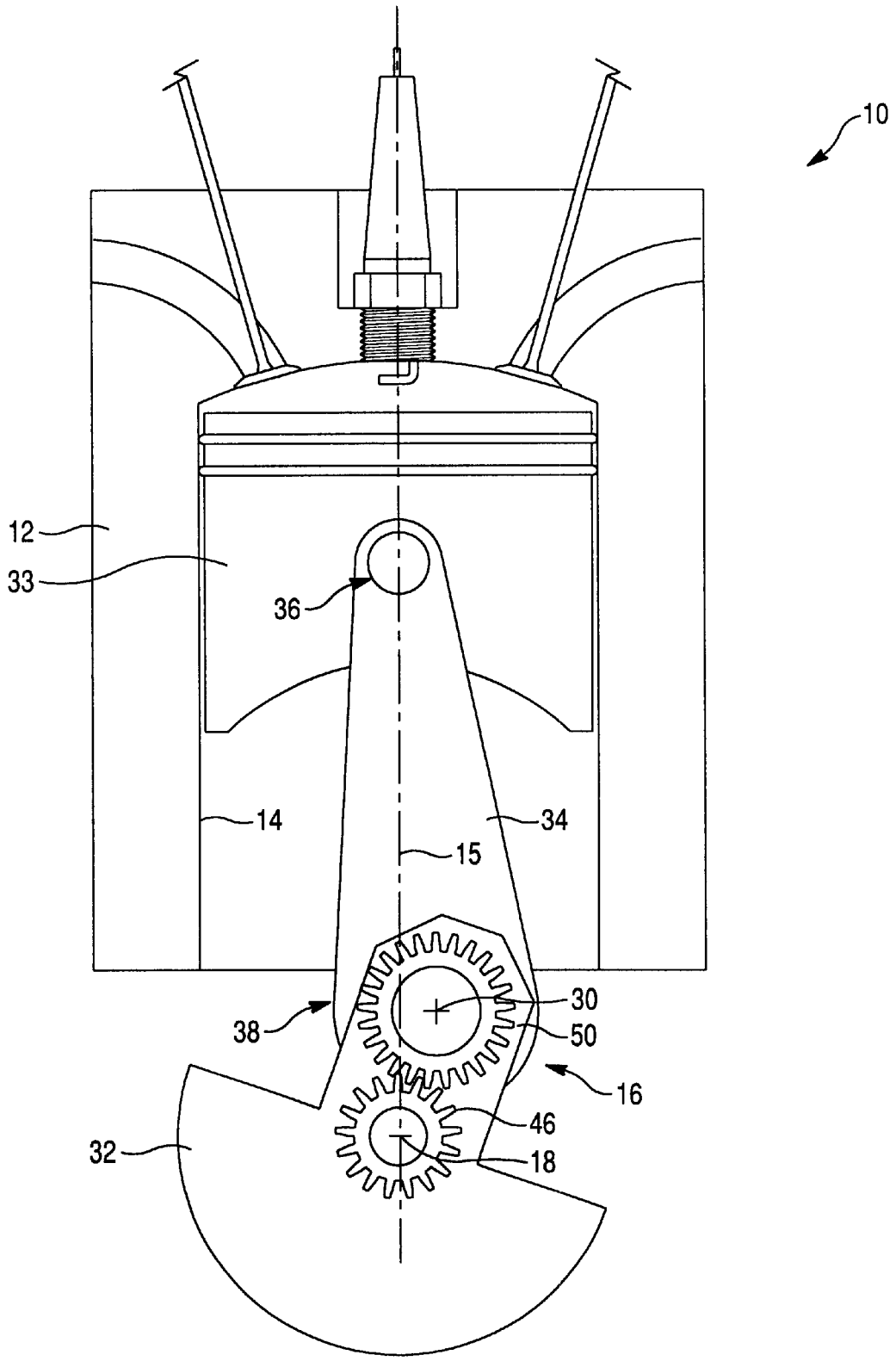
FIG. 1 is a schematic view showing an internal combustion engine in accordance with the first embodiment of the present invention.

Referring now to FIG. 1, an improved internal combustion engine according to the preferred embodiment of the present invention illustrated generally at 10 and comprises an engine block assembly 12 forming a cylinder 14 having a central axis 15. It should be noted that the engine block 12 is shown generally diagrammatically as a support for components of the engine in according to the present invention. Further, for illustrative purposes, the engine is shown as a one-cylinder engine. Nevertheless, it will be appreciated by those skilled in the art that two-cylinder engines or virtually any multi-cylinder engines, in varied configurations may be adapted to use the present invention.

The internal combustion engine is provided with a crankshaft assembly 16 rotatably mounted to the block assembly 12 for rotation about a crank axis 18. A conventional piston 33 is disposed within the cylinder 14 for reciprocating movement therewithin between a top dead center (TDC) and a bottom dead center (BDC). The piston 33 is connected to the crankshaft assembly 16 through a conventional connecting rod 34 having a first end 36 pivotally mounted to the piston 33, and a second end 38 rotatably mounted to the crankshaft assembly 16.

Figure 2A:
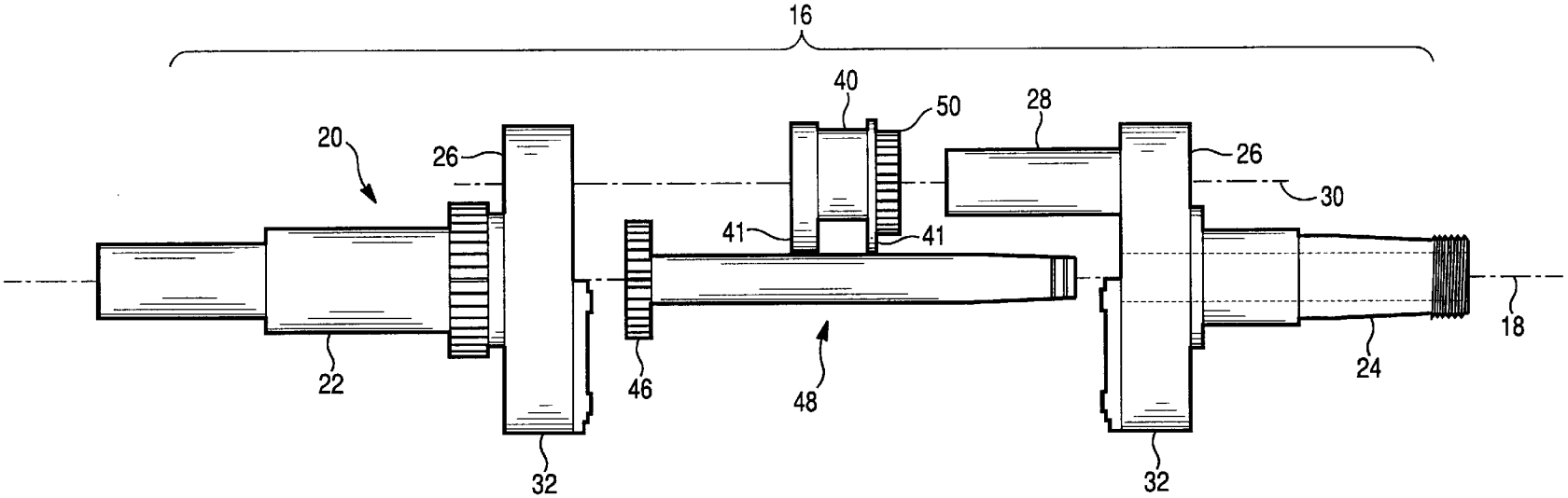
FIG. 2A is an exploded view of a crankshaft assembly in accordance with the first embodiment of the present invention.
Figure 2C:
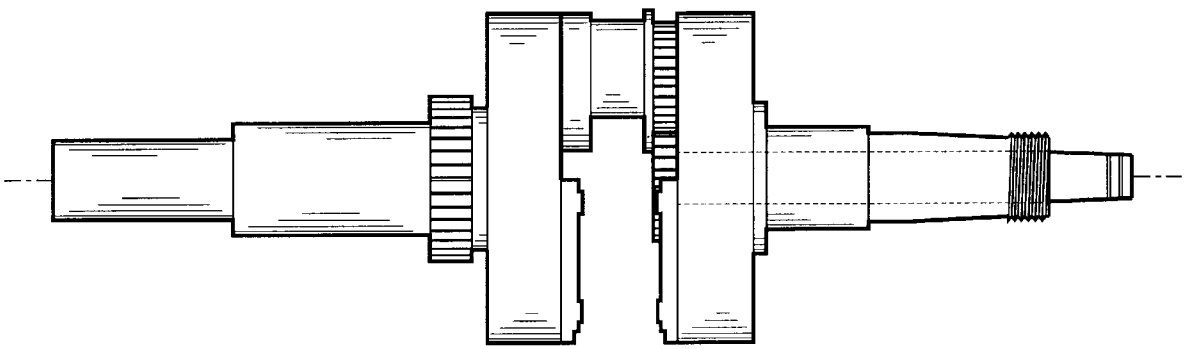
FIG. 2C is a side elevational view of the crankshaft assembly in accordance with the first embodiment of the present invention.
Figure 2B:
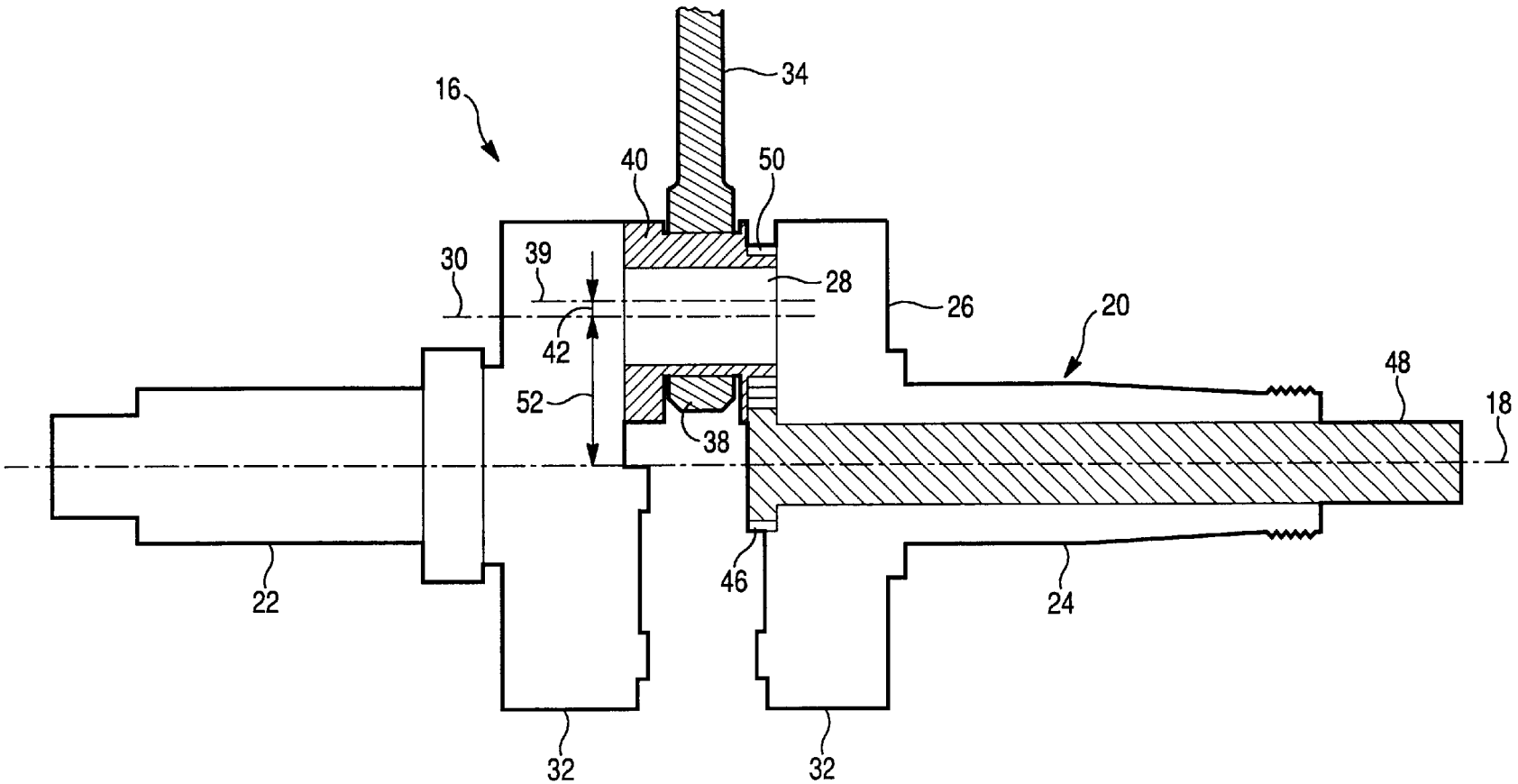
FIG. 2B is a sectional view of the crankshaft assembly in accordance with the first embodiment of the present invention.

As illustrated in FIGS. 2A and 2B, the crankshaft assembly 16 comprises a driveshaft 20 including a first portion 22 and a second hollow portion 24. The first and second portions 22 and 24 of the driveshaft 20 are fixedly attached to crank arms 26 which in turn are fixedly attached to each other by a crankpin 28 thus forming a crankthrow of the crankshaft assembly 16. The crankpin 28 has a crankpin axis 30 that is parallel and radially spaced from the crank axis 18. Counterweights 32 are included to the crankshaft assembly 16 for balancing.

The second end 38 of the connecting rod 34 is rotatably mounted to the crankpin 28 for rotation about a connecting rod axis 39, as illustrated in FIG. 2B.

A side elevational view of the assembled crankshaft assembly 16 in accordance with the first embodiment of the present invention is illustrated in FIG. 2C.

With the reference to FIGS. 2A and 2B, an eccentric member 40 is rotatably mounted upon the crankpin 28. The second end 38 of the connecting rod 34 is mounted to the crankpin 28 through the eccentric member 40. Thus, the connecting rod axis 39 is parallel to, but radially spaced from the crankpin axis 30 forming an eccentric lever 42 radially extending between the crankpin axis 30 and the connecting rod axis 36. The eccentric lever 42 defines an eccentricity of the eccentric member 40. Preferably, the eccentric member 40 is provided with counterweights 41 (see FIGS. 2A and 2B).

In order to rotate the eccentric member 40 relative to the crankpin 28, a gear set is provided. As shown in FIGS. 2A and 2B, the gear set includes a first gear 46 non-rotatably mounted to the engine block assembly 12 coaxially with the crank axis 18, and a second gear 50 operatively engaging the first gear 46 for rotation thereabout in a planetary manner. Preferably, the first gear 46 is fixedly secured to a spindle shaft 48 extending through the second hollow portion 24 of the driveshaft 20, and is rigidly connected to the engine block assembly 12. It will be appreciated that any other appropriate means to non-rotatably secure the first gear 46 to the engine block assembly 12 are within the scope of the present invention. The second gear 50 is concentrically mounted to the crankpin 28 for rotation about the crankpin axis 30. At the same time, the second gear 50 is drivingly coupled to the eccentric member 40. Preferably, the second gear 50 is integral part of the eccentric member 40. Therefore, it will be appreciated to those skilled in the art that with the rotation of the crankshaft assembly 16 the eccentric member 40 will be rotated on the crankpin 28 and will constantly alter its position relative thereto.

In accordance with the present invention, a number of teeth formed on the first gear 46 equals to a number of teeth formed on the second gear 50, thereby forming a 1:1 gear ratio so that the gear set causes the eccentric member 40 to rotate one full revolution about the crankpin 28 with every one full revolution of the crankshaft assembly 16. The eccentric member 40 rotates in a direction of rotation of the crankshaft assembly 16.

Those skilled in the art will appreciate that the engine thusly described lacks any valve system, cooling system, ignition system, and the accompanying structural components to provide a fully operational internal combustion engine. These components are beyond the scope of the present invention and are omitted so that the present invention may be described with greater clarity and the aforesaid necessary systems do not differ from the standard internal combustion engine. Any suitable valve system, cooling system, ignition system, and associated structural components will operate satisfactorily with the present invention and it should be noted that the present invention is adaptable to virtually any standard crankdriven internal combustion engines.

As seen in the accompanying drawings, three rotational axes are defined. Initially, the crankshaft 16 rotates about a crankshaft axis 18 which, as seen in FIGS. 2A and 2B. The eccentric member 40 rotates about the crankpin axis 30, which extends parallel to the crankshaft axis 18 and is offset therefrom by a predetermined distance of a crankshaft offset 52 (see FIG. 2B). This crankshaft offset 52 is present in every crank-driven internal combustion engine and provides an arm through which the pumping action of the piston is translated into rotation of the crankshaft assembly 16. Due to the presence of the eccentric member 40, the connecting rod 34 rotates about connecting rod axis 39, which also extends parallel to the crankshaft axis 18 and the crankpin axis 30. The distance between the crankpin axis 30 and the connecting rod axis 39 has been defined above as the eccentric lever 42 and the eccentric lever 42 combines with the crankshaft offset 52 to define an effective crank length which, as will be seen in greater detail hereinafter, varies throughout the every revolution of the crankshaft assembly 16.

The linear movement of the piston 33 in the cylinder 15 is a net sum of the changes that occur in the movements of the connecting rod 34, the crankpin 28 and the eccentric member 40 at each crank angle as the crankshaft assembly 16 rotates around the crankshaft axis 18.

As in conventional internal combustion engines, during the expansion or power phase, combustion of an air-fuel mixture in a combustion chamber of the cylinder drives the piston downwardly and causes rotation of the crankshaft. As well known to those skilled in the art, the expansion phase is a two-part process. The first part is a generating of exhaust gas pressure trough the combustion of the air-fuel mixture in the combustion chamber; the second part is a transformation of the thermal energy of air-fuel mixture into a mechanical energy of the rotating crankshaft by harnessing the combustion pressure through the connecting rod and crankshaft assembly.

It is well known that during the initial phase of the expansion process, as the crankshaft moves the piston to its TDC, there are several degrees of rotation of the crankshaft assembly when the piston is at rest before its motion is reversed and it begins to move downward, toward the BDC. This position of the piston when the piston is at rest, is called a dwell point, and is measured in degrees of the crankshaft rotation. The longer the dwell point, the more efficient is the transformation of the thermal energy of air-fuel mixture into the mechanical energy, because the longer the volume of the combustion chamber is at a minimum, higher the combustion pressure built up. And higher pressure in the beginning translates into a greater average mean pressure throughout the entire power phase. There is also a secondary mechanical advantage in having a longer dwell point: since the piston dwells longer at the TDC, the crank arms 26 reach a greater angle of leverage before the piston begins to move toward the BDC. This allows the combustion pressure to be more efficiently converted to the mechanical energy during the time when the combustion pressure is at its maximum.

The improved internal combustion engine of the present invention acts to increase the dwelling point of the piston 33 in order to achieve the higher engine efficiency. In accordance with the preferred embodiment of the present invention, when assembling the engine, the eccentric member 40 is positioned on the crankpin 28 so that when the piston 33 is at its TDC position, the offset lever 42 (i.e. a line between the connecting rod axis and the crankpin axis) is substantially perpendicular to the central axis 15, as illustrated in FIG. 3A.

In operation, when the crankshaft rotates clockwise, the second gear 50 rotates the eccentric member 40 clockwise as it rolls over the first gear 46. The linear displacement of the piston 33 in the cylinder 12 is the net sum of changes that occur in the linear movements of the connecting rod 34, crankpin 28, and the eccentric member 40 at each crankshaft angle. As the piston 33 moves past its TDC position (as shown in FIG. 3A), the crankshaft assembly 16 moves the connecting rod 34 and the piston 33 down the cylinder,12, while the rotating eccentric member 40 is simultaneously moving the connecting rod 34 and the piston 33 back up the cylinder 15. Thus, the dwell point of the piston of the internal combustion engine of the present invention is substantially extended relative to the dwell point of the piston of the conventional engines. Comparison curves of a piston displacement for a full crankshaft revolution for the conventional stock engine and the improved engine of the present invention are shown in FIG. 4.

Figure 3A:
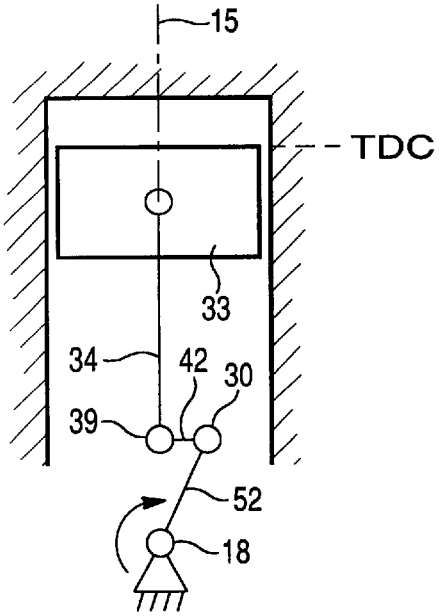
FIG. 3A is diagrammatic view of the internal combustion engine in accordance with the first preferred embodiment of the present invention when a piston is at TDC position.
Figure 3B:
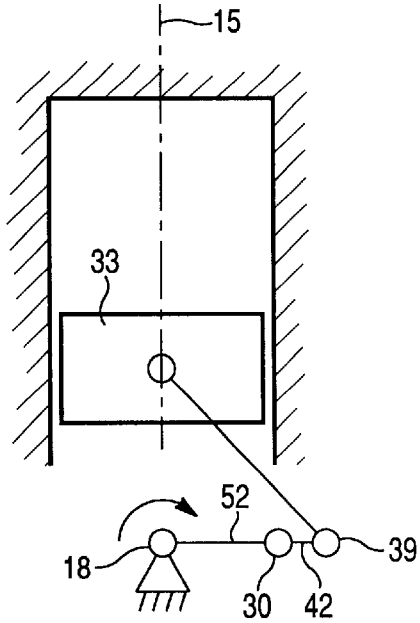
FIG. 3B is diagrammatic view of the internal combustion engine in accordance with the first preferred embodiment of the present invention at 90° of a crank angle.
Figure 4:
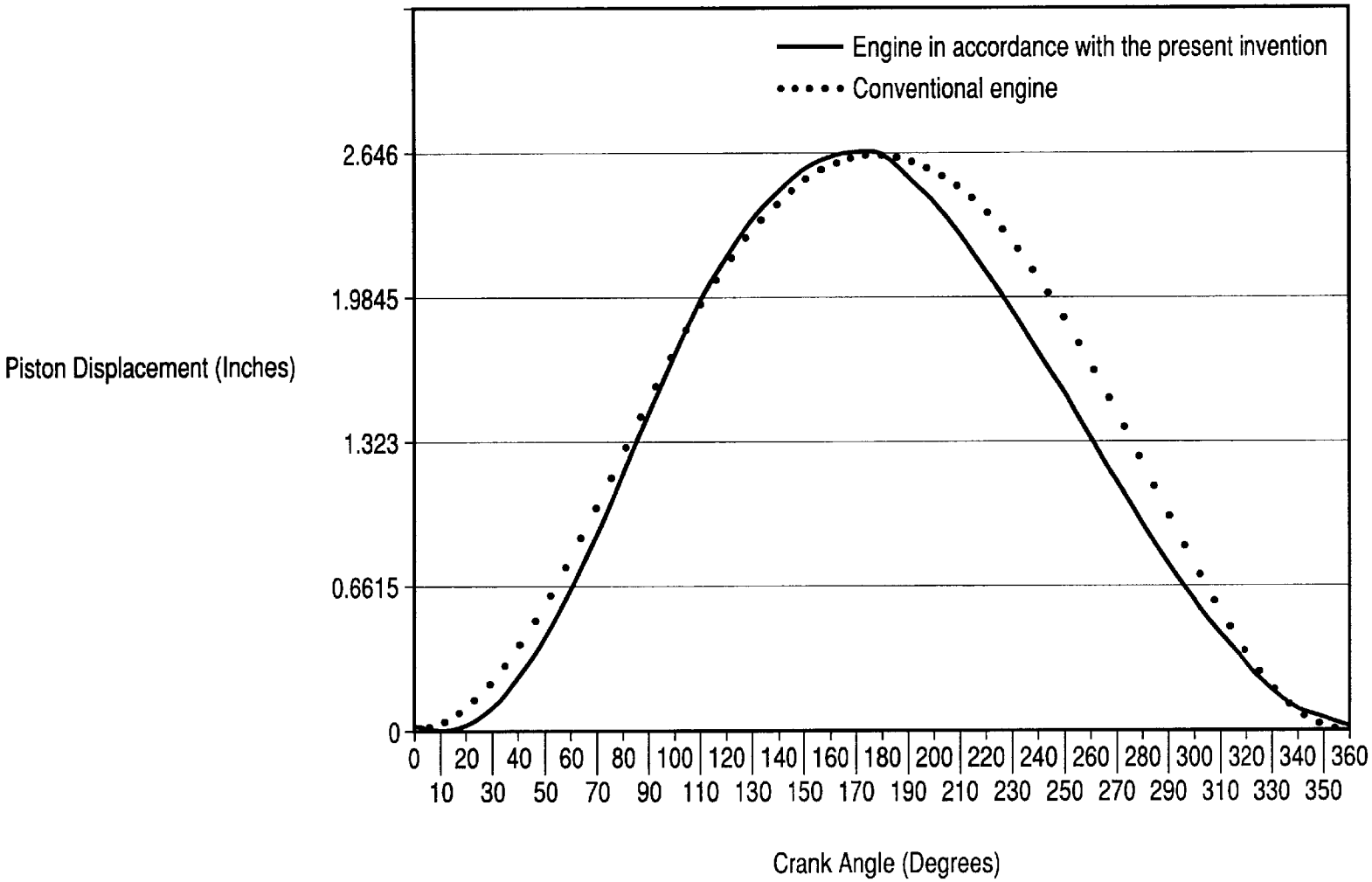
FIG. 4 shows stroke curves (piston displacement versus crank angle) for a complete crank arm revolution for the conventional internal combustion engine and the internal combustion engine in accordance with the present invention.

As illustrated in FIGS. 3A and 3B, within ranges of approximately 0°–90° of the crank angle, the effective crank length (the sum of the eccentric lever 42 and the crankshaft offset 52) is increasing, thus converting combustion gas pressure to useful work more efficiently during the expansion phase of the power cycle.

Figure 3C:
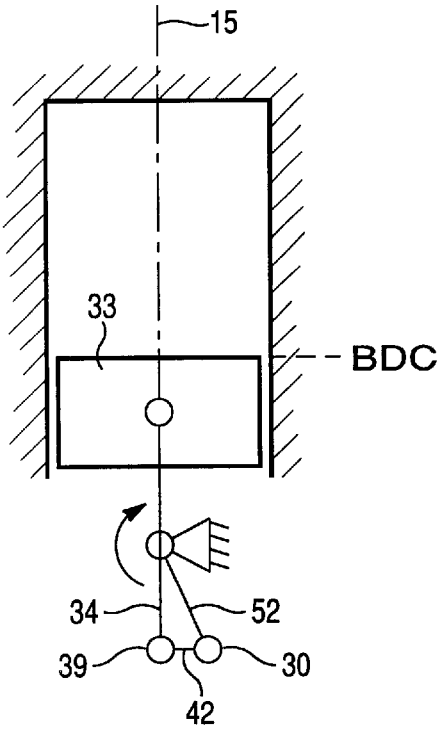
FIG. 3C is diagrammatic view of the internal combustion engine in accordance with the first preferred embodiment of the present invention when the piston is at BDC position.
Figure 3D:
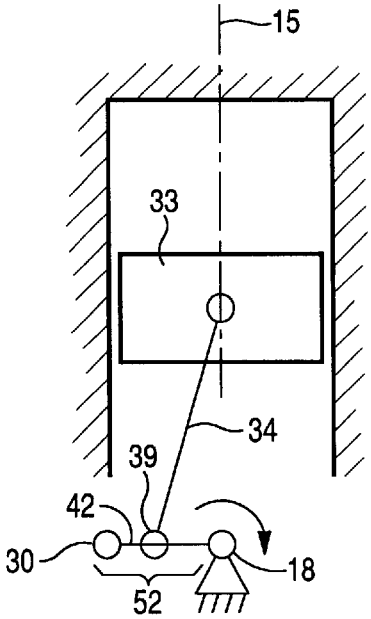
FIG. 3D is diagrammatic view, of the internal combustion engine in accordance with the first preferred embodiment of the present invention at 270° of the crank angle.

As further illustrated in FIGS. 3C and 3D, within ranges of approximately 180°–270° of the crank angle, the effective crank length (the sum of the eccentric lever 42 and the crankshaft offset 52) is decreasing, thus the work done by the piston during the exhaust phase of the power cycle is reduced.

For illustrative purposes, the internal combustion engine of the present invention was described as a one-cylinder engine. Nevertheless, it will be appreciated by those skilled in the art that two-cylinder engines or virtually any multi-cylinder engines, in varied configurations may be adapted to use the present invention, such as multi-cylinder in-line engines, "V" configuration engines, opposed-cylinder engines.

Figure 5:
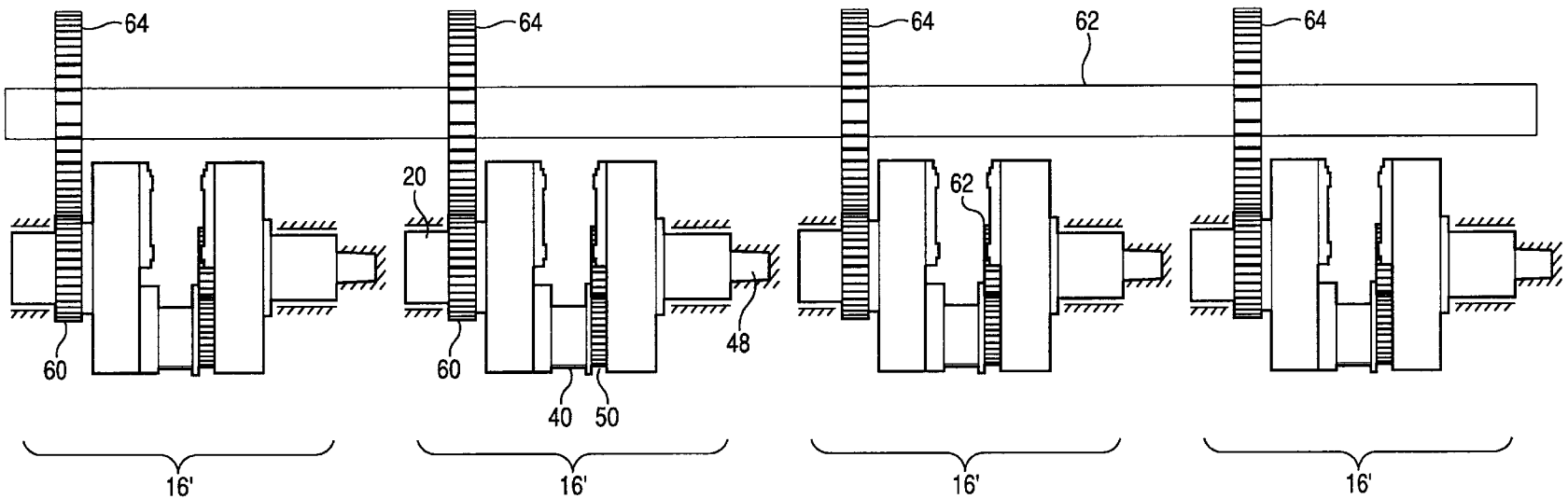
FIG. 5 is a schematic view of a multi-cylinder in-line engine in accordance with the second embodiment of the present invention.

The FIG. 5 illustrates second embodiment of the present invention where the variable ration crankshaft assembly of the present invention is adapted for a four-cylinder in-line engine. The engine includes four separate crankshaft assemblies 16' each similar to the crankshaft assembly 16 disclosed above with the reference to the first embodiment of the present invention. In contrast with the crankshaft assembly 16, the driveshaft 20 of the crankshaft assembly 16' is provided with an input gear 60 rigidly mounted thereto. Furthermore, the engine includes an output shaft 62 coupled to a vehicle transmission (not shown). The output shaft 62 is provided with four axially spaced output gears 64 each rigidly mounted to the output shaft 62 and operatively engaging the input gears 60. Obviously, the number-of the output gears 64 corresponds to the number crankshaft assemblies 16'. The input gears 60 transfer torque generated by the engine 10' from the crankshaft assemblies 16' to the output shaft 62.

It will be appreciated by those skilled in the art that any engine having in-line configuration with any numbers of cylinders, such two, three, five, six, etc., has similar construction, and is within the scope of the present invention.

Figure 6:
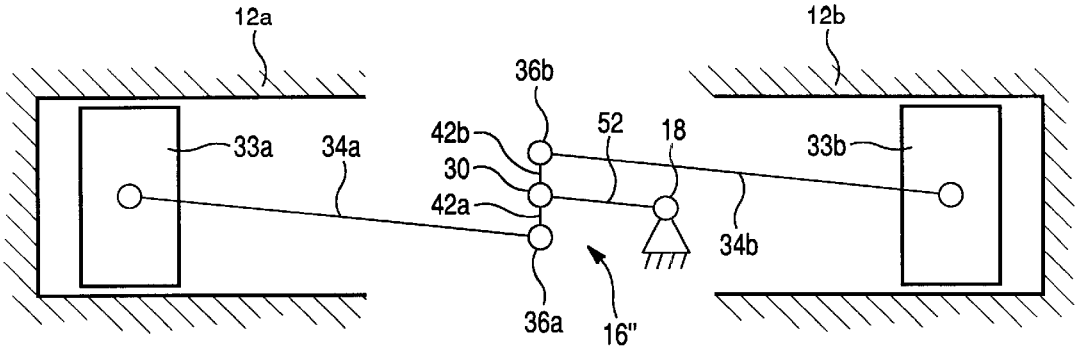
Fig. 6 is a schematic view of an opposed-cylinder engine in accordance with the third embodiment of the present invention.

FIG. 6 schematically illustrates an opposed-cylinder engine in accordance with the third embodiment of the present invention, comprising a pair of oppositely arranged cylinders 12*a* and 12*b* housing reciprocating pistons 33*a* and 33*b* respectively. The pistons 33*a* and 33*b* are connected to a crankshaft assembly 16" through corresponding connecting rods 34*a* and 34*b*. The crankshaft assembly 16" is similar to the crankshaft assembly 16 disclosed above with the reference to the first embodiment of the present invention, except that two eccentric members 40*a* and 40*b* are mounted upon a crankpin of the crankshaft assembly 16". It will be appreciated that the eccentric members 40*a* and 40*b* are positioned opposite to each other, i.e. timed out of phase 180°. It would be obvious to those skilled in the art that the above described opposedcylinder engine may have any even number of cylinders, such as two, four, six, etc.

Figure 7:
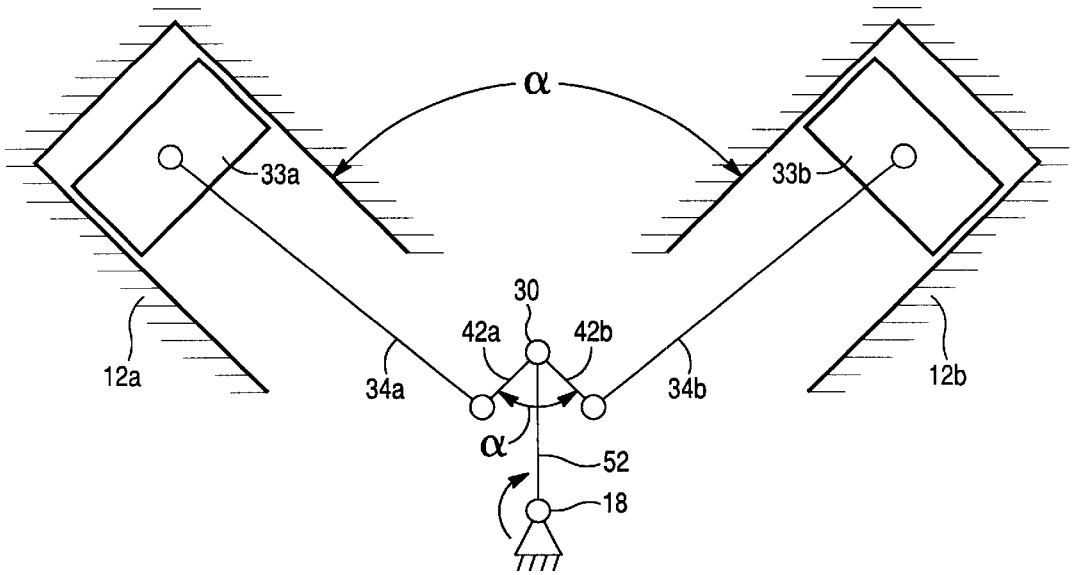
FIG. 7 is a schematic view of a "V" configuration engine in accordance with the forth embodiment of the present invention.

It will be appreciated that the "V" configuration multi-cylinder engines are also within the scope of the present invention. As is well known, V" configuration engines include two banks of cylinders arranged in two intersecting planes forming an angle α. FIG. 7 schematically illustrates a "V" configuration engine in accordance with the forth embodiment of the present invention, comprising two banks of cylinders 12*a* and 12*b* lying at the angle α to each other. The cylinders 12*a* and 12*b* house reciprocating pistons 33*a* and 33*b* respectively. The pistons 33*a* and 33*b* are connected to a crankshaft assembly 16'" through corresponding connecting rods 34*a* and 34*b*. The crankshaft assembly 16'" is similar to the crankshaft assembly 16" disclosed above with the reference to the third embodiment of the present invention, except that two eccentric members 40*a* and 40*b* mounted on a crankpin of the crankshaft assembly 16'" and 40*b* are timed out of phase to the angle α. It would be obvious to those skilled in the art that the above described "V", configuration engine may have any even number of cylinders, such as two, four, six, etc.

Therefore, the internal combustion engine in accordance with the present invention includes a novel arrangement of the crankshaft assembly provided with an eccentric member acting to produce an extended dwell point of engine pistons and provide better leverage in order to more efficiently convert combustion pressure to mechanical energy.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed herein above were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. An internal combustion engine comprising:

an engine block assembly including at least one cylinder formed therein, said cylinder having a central axis;

a piston reciprocating in said cylinder between a top dead center (TDC) position and a bottom dead center (BDC) position;

at least one crankshaft assembly rotatably mounted to said engine block assembly for rotation about a crank axis; said crankshaft assembly including a driveshaft, a crankarm fixed to said driveshaft and a crankpin fixed to said crankarm;

at least one connecting rod having a first end pivotally mounted to said piston and a second end rotatably mounted to said crankpin; said first end of said connecting rod rotates about a first connecting rod axis parallel to said crank axis and said second end of said connecting rod rotates about a second connecting rod axis parallel to said crank axis;

at least one gear set including a stationary first gear coaxial with said crank axis and a rotatable second gear mounted concentrically on said crankpin, said second gear operatively engaged with said first gear; and at least one eccentric member mounted on said crankpin for rotation about a crankpin axis and interposed between said crankpin and said connecting rod; said eccentric member rigidly secured to said second gear; said eccentric member defines an offset lever between said crankpin axis and said second connecting rod axis; said eccentric member positioned on said crankpin so that rotation of said eccentric member by said gear set produces an extended dwell point of said piston.

2. The internal combustion engine as defined in claim 1, wherein said eccentric member positioned on said crankpin so that said offset lever is substantially perpendicular to said central axis when said piston is in said TDC position.

3. The internal combustion engine-as defined in claim 1, wherein a number of teeth formed on said first gear equals to a number of teeth formed on said second gear, thereby forming a 1:1gear ratio so that cause said eccentric member to rotate one full turn about said crankpin with every one full turn of said crankshaft assembly.

4. The internal combustion engine as defined in claim 1, wherein said first gear is non-rotatbly mounted to said engine block assembly.

5. The internal combustion engine as defined in claim 1, wherein said second gear is integral with said eccentric member.

6. The internal combustion engine as defined in claim 1, wherein said eccentric member includes at least one counterweight.

7. The internal combustion engine as defined in claim 1, wherein the internal combustion engine operates according to a two-stroke cycle.

8. The internal combustion engine as defined in claim 1, wherein the internal combustion engine operates according to a four-stroke cycle.

9. The internal combustion engine as defined in claim 1, wherein said driveshaft including a tubular portion, and said first gear is fixed to a spindle shaft extending through said tubular portion of said driveshaft, wherein said spindle shaft is non-rotatably coupled to said engine block.

10. The internal combustion engine as defined in claim 1, further including an engine output shaft rotatably mounted to said engine block, at least one output gear drivingly mounted to said output shaft and an input gear drivingly mounted to said driveshaft, wherein said output gear operatively engaging said input gear.

11. The internal combustion engine as defined in claim 1, wherein the internal combustion engine is a multi-cylinder engine having a number of said cylinders, a corresponding number of pistons, connecting rods and eccentric members and a number of crankshaft assemblies.

12. The internal combustion engine as defined in claim 11, wherein said multi-cylinder engine has an in-line configuration and the number of crankshaft assemblies corresponds in number to the number of said cylinders.

13. The internal combustion engine as defined in claim 12, further including an engine output shaft rotatably mounted to said engine block, a number of output gears corresponding in number to the number of said cylinders drivingly mounted to said output shaft and a number of input gears each drivingly mounted to said driveshafts, wherein each of said output gears operatively engaging complementary input gear.

14. The internal combustion engine as defined in claim 11, wherein said multicylinder engine has an opposed-cylinder configuration.

15. The internal combustion engine as defined in claim 11, wherein said multicylinder engine has a "V" configuration.

16. An internal combustion engine comprising:

an engine block assembly having at least one cylinder formed therein, said cylinder having a central axis;

a piston reciprocating in said cylinder between a top dead center (TDC) position and a bottom dead center (BDC) position;

at least one crankshaft assembly rotatably mounted to said block assembly for rotation about a crank axis; said crankshaft assembly including a driveshaft, at least one crankarm fixed to said driveshaft and at least one crankpin fixed to said crankarm;

an input gear drivingly mounted to said driveshaft;

at least one connecting rod having a first end pivotally mounted to said piston and a second end rotatably mounted to said crankpin; said first end of said connecting rod rotates about a first connecting rod axis parallel to said crank axis and said second end of said connecting rod rotates about a second connecting rod axis parallel to said crank axis;

at least one gear set including a stationary first gear non-rotatbly mounted to said engine block assembly coaxially with said crank axis and a rotatable second gear mounted concentrically on said crankpin, said second gear operatively engaged with said first gear, wherein a number of teeth formed on said first gear equals to a number of teeth formed on said second gear, thereby forming a 1:1 gear ratio so that cause said eccentric member to rotate one full turn about said crankpin with every one full turn of said crankshaft assembly;

at least one eccentric member integral with said second gear and mounted on said crankpin for rotation about a crankpin axis and interposed between said crankpin and said connecting rod; said eccentric member defines an offset lever between said crankpin axis and said second connecting rod axis; said eccentric member positioned on said crankpin so that said offset lever is substantially perpendicular to said central axis when said piston is in said TDC position and rotation of said eccentric member by said gear set produces an extended dwell point of said piston;

an engine output shaft rotatably mounted to said engine block; and at least one output gear drivingly mounted to said output shaft, wherein said output gear operatively engaging said input gear.

17. An internal combustion engine comprising:

an engine block assembly having a number of cylinders formed therein, said cylinder having a central axis;

a number of pistons corresponding in number to the number of said cylinders, said pistons reciprocating in said cylinders between a top dead center (TDC) position and a bottom dead center (BDC) position;

a number of crankshaft assemblies-corresponding in number to the number of said cylinders, said crankshaft asssemblies rotatably and coaxially mounted to said block assembly for rotation about a crank axis; each of said crankshaft assemblies including a driveshaft, at least one crankarm fixed to said driveshaft and at least one crankpin fixed to said crankarm;

a number of input gears each drivingly mounted to said driveshafts;

a number of connecting rods corresponding in number to the number of said cylinders, each of said connecting rods having a first end pivotally mounted to said piston and a second end rotatably mounted to said crankpin; said first end of said connecting rod rotates about a first connecting rod axis parallel to said crank axis and said second end of said connecting rod rotates about a second connecting rod axis parallel to said crank axis;

a number of gear sets corresponding in number to the number of said cylinders, each of said gear sets including a stationary first gear non-rotatbly mounted to said engine block assembly coaxially with said crank axis and a rotatable second gear mounted concentrically on said crankpin, said second gear operatively engaged with said first gear, wherein a number of teeth formed on said first gear equals to a number of teeth formed on said second gear, thereby forming a 1:1 gear ratio so that cause said eccentric member to rotate one full turn about said crankpin with every one full turn of said crankshaft assembly;

a number of eccentric members corresponding in number to the number of said cylinders; each of said eccentric members is drivingly coupled to said second gear and mounted on said crankpin for rotation about a crankpin axis and interposed between said crankpin and said second end of said connecting rod; each of said eccentric members defines an offset lever between said crankpin axis and said second connecting rod axis; each of said eccentric member positioned on said crankpin so that said offset lever is substantially perpendicular to said central axis when said piston is in said TDC position and rotation of said eccentric member by said gear set produces an extended dwell point of said piston;

an engine output shaft rotatably mounted to said engine block; and a number of output gears corresponding in number to the number of said cylinders; each of said output gears drivingly mounted to said output shaft, wherein each of said output gears operatively engaging corresponding input gear.

* * * * *